US009576546B2

(12) United States Patent
Lee et al.

(10) Patent No.: US 9,576,546 B2
(45) Date of Patent: Feb. 21, 2017

(54) METHOD FOR DRIVING DATA, DATA DRIVE CIRCUIT FOR PERFORMING THE METHOD, AND DISPLAY APPARATUS HAVING THE DATA DRIVE CIRCUIT

(75) Inventors: Jae-Han Lee, Asan-si (KR); Sun-Kyu Son, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1371 days.

(21) Appl. No.: 12/420,445

(22) Filed: Apr. 8, 2009

(65) Prior Publication Data

US 2010/0085293 A1 Apr. 8, 2010

(30) Foreign Application Priority Data

Oct. 6, 2008 (KR) ..... 10-2008-0097586

(51) Int. Cl.
*G09G 3/36* (2006.01)

(52) U.S. Cl.
CPC ..... *G09G 3/3688* (2013.01); *G09G 3/3614* (2013.01); *G09G 2300/0413* (2013.01); *G09G 2300/0426* (2013.01); *G09G 2310/0297* (2013.01)

(58) Field of Classification Search
CPC .. G09G 3/3614; G09G 3/3695; G09G 3/3688; G09G 2300/0413
USPC ..... 345/208, 209, 211, 214
See application file for complete search history.

(56) References Cited

U.S. PATENT DOCUMENTS

| | | | | |
|---|---|---|---|---|
| 6,563,743 | B2 * | 5/2003 | Hanzawa et al. | 365/189.02 |
| 6,862,232 | B2 * | 3/2005 | Hanzawa et al. | 365/189.02 |
| 7,038,753 | B2 * | 5/2006 | Kim | 349/139 |
| 9,286,820 | B2 * | 3/2016 | Chang | G09G 3/20 |
| 2005/0134544 | A1 | 6/2005 | Igarashi et al. | |
| 2005/0243044 | A1 * | 11/2005 | Kang et al. | 345/87 |
| 2007/0146518 | A1 * | 6/2007 | Hong et al. | 348/308 |

FOREIGN PATENT DOCUMENTS

| | | | | |
|---|---|---|---|---|
| JP | 09-016132 | | 1/1997 | |
| JP | 11-102174 | | 4/1999 | |
| JP | 2001-042287 | | 2/2001 | |
| JP | 2003-233362 | | 8/2003 | |
| JP | 2006-071891 | | 3/2006 | |
| JP | 2007-524126 | | 8/2007 | |
| JP | 2007328073 | | 12/2007 | |
| JP | 2008-216982 | | 9/2008 | |
| KR | 20020012903 | * | 2/2002 | G09G 3/36 |
| KR | 100349347 | | 8/2002 | |
| KR | 1020050024415 | | 3/2005 | |
| KR | 10598741 | | 7/2006 | |
| KR | 10-0637369 | | 10/2006 | |
| WO | 2004/097787 | | 11/2004 | |

* cited by examiner

*Primary Examiner* — Jonathan Horner
(74) *Attorney, Agent, or Firm* — H.C. Park & Associates, PLC

(57) ABSTRACT

The present invention discloses a data driving method, the method including receiving data corresponding to a plurality of pixels. Received data are converted into data voltages of an analog type to be output to a plurality of data lines. One of a first data voltage and a last data voltage of the data voltages is output to a dummy data line adjacent to the data lines.

15 Claims, 5 Drawing Sheets

METHOD FOR DRIVING DATA, DATA DRIVE CIRCUIT FOR PERFORMING THE METHOD, AND DISPLAY APPARATUS HAVING THE DATA DRIVE CIRCUIT

CROSS REFERENCE TO RELATED APPLICATION

This application claims priority from and the benefit of Korean Patent Application No. 2008-97586, filed on Oct. 6, 2008, which is hereby incorporated by reference for all purposes as if fully set forth herein.

BACKGROUND OF THE INVENTION

Field of the Invention

The present invention relates to a method of driving data, a data drive circuit for performing the method, and a display apparatus having the data drive circuit.

Discussion of the Background

A liquid crystal display (LCD) apparatus may include an LCD panel, a printed circuit board (PCB) including a drive chip driving the LCD panel, source tape carrier packages (TCPs) including source drive chips, and gate TCPs including gate drive chips. The TCPs electrically connect the LCD panel with the PCB.

A gate-integrated circuit-less (GIL) structure, in which the gate TCPs have been removed and the gate drive circuit is directly formed on the LCD panel, has been developed and applied in the LCD apparatus as a solution for reducing the size and manufacturing costs thereof.

Additionally, a structure in which different color pixels are connected to one source line for reducing the number of source drive chips, that is, a horizontal pixel structure, may be employed. The horizontal pixel structure may be formed, in which a long side of the structure is formed in the horizontal direction of each of red, green, and blue pixels and a short side of the structure is formed in the vertical direction of each of red, green, and blue pixels.

When the horizontal pixel structure is employed, the red, green, and blue pixels may be connected to the same source line so that the pixels are respectively driven while dividing a horizontal period (1H) into 1/3H, thereby reducing the number of the source lines by 1/3.

A column inversion driving method may be used, in which different polarity data voltages are applied to adjacent source lines to compensate for a reduced charging time in the horizontal pixel structure and reduce power consumption. In addition, a different structure may be used, in which pixels are alternately connected in the column to adjacent source lines for acquiring a dot inversion effect through the column inversion driving method.

SUMMARY OF THE INVENTION

The present invention provides a method of driving data capable of reducing the size of a data drive circuit and simplifying the structure thereof.

The present invention also provides a data drive circuit for performing the method of driving data.

The present invention also provides a display apparatus having the data drive circuit.

Additional features of the invention will be set forth in the description which follows, and in part will be apparent from the description, or may be learned by practice of the invention.

The present invention discloses a method of driving data. In the method, data corresponding to a plurality of pixels are received. Then, the received data are converted into data voltages of an analog type to be outputted to a plurality of data lines. Then, one of a first data voltage and a last data voltage of the data voltages is outputted to a dummy data line adjacent to the data lines.

The present invention also discloses a data drive circuit including a latch part, a digital-to-analog conversion part, an output part and a dummy output part. The latch part receives data that corresponds to a plurality of pixels, and outputs the data. The digital-to-analog conversion part converts the data outputted from the latch part into data voltages of an analog type. The output part buffers the data voltages to respectively output the data voltages to a plurality of data lines. The dummy output part receives a first data voltage and a last data voltage from the output part, and the dummy output part outputs one of the first data voltage and the last data voltage to a dummy data line adjacent to the data lines.

The present invention also discloses a display apparatus including a display panel and a data drive circuit. The display panel includes a plurality of data lines, a dummy data line adjacent to the data lines and a plurality of gate lines that cross the data lines. The data drive circuit includes an output part to output data voltages to the data lines and a dummy output part to receive a first data voltage and a last data voltage of the data voltages, the dummy output part to output one of the first data voltage and the last data voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
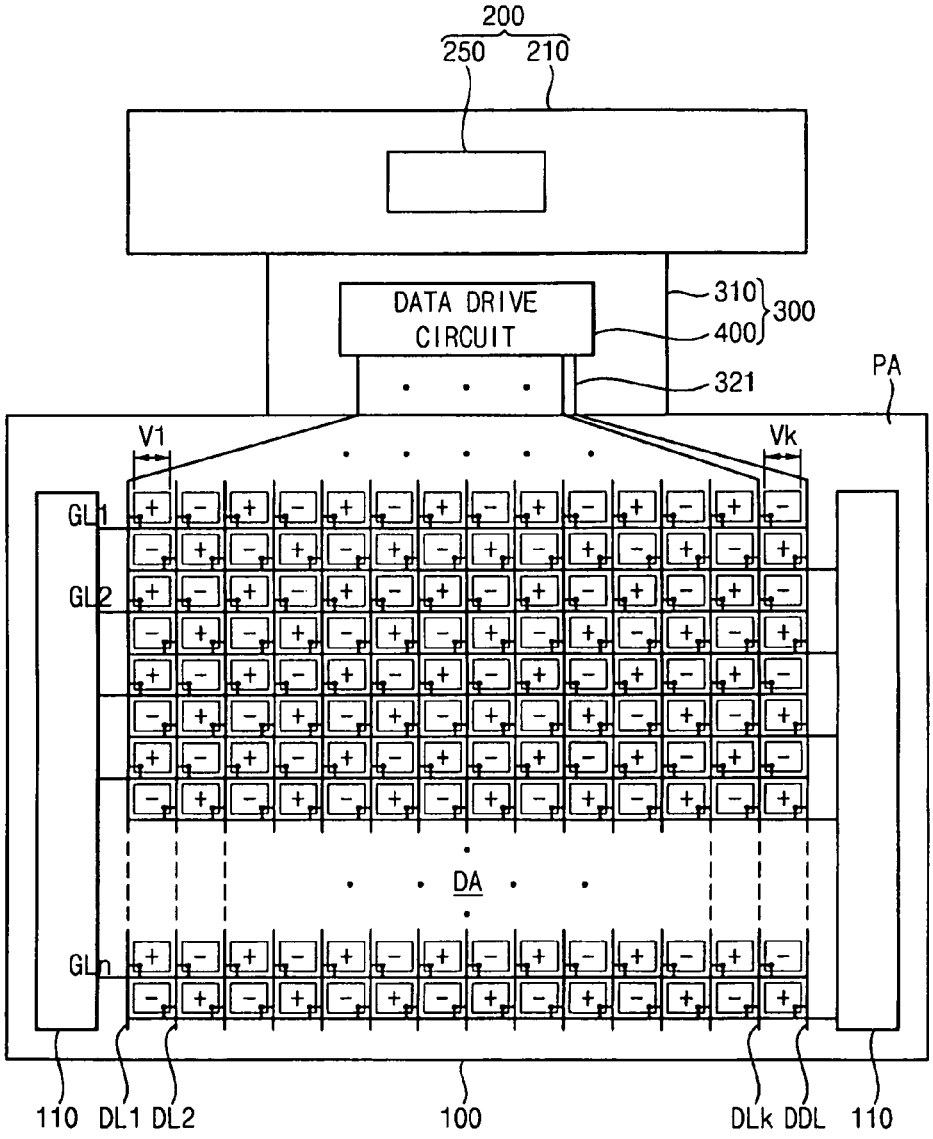
FIG. 1 is a plan view showing a display panel according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the present invention will be explained in detail with reference to the accompanying drawings.

FIG. 1 is a plan view showing a display panel according to an exemplary embodiment.

Referring to FIG. 1, a display apparatus includes a display panel 100, a control module 200, and a drive module 300.

The display panel 100 includes a display area DA in which a plurality of pixels, which display an image, are disposed and a peripheral area PA surrounding the display area DA. A gate drive circuit 110 for driving the pixels is disposed in the peripheral area PA. The gate drive circuit 110 may be integrated on the substrate in the peripheral area PA. Alternatively, the gate drive circuit 110 may be mounted in a chip form or mounted using a tape carrier package (TCP). As shown in FIG. 1, a gate drive circuit 110 is disposed in the peripheral area PA at both ends of gate lines. Alternatively, the gate drive circuit 110 may be disposed in the peripheral area PA at one end of the gate lines.

A plurality of gate lines GL1, . . . , GLn-1, and GLn, each of which extend in a first direction, and a plurality of data lines DL1, . . . , DLk-1, and DLk, each of which extend in a second direction, are disposed in the display area DA. A dummy data line DDL, which is adjacent to a last data line DLk, is also disposed in the display area DA. Alternatively, the dummy data line DDL may be adjacent to the first data line DL1.

The number of the plurality of pixels is defined by the gate lines GL1, . . . , GLn-1, and GLn, the data lines DL1, . . . , DLk-1, and DLk, and the dummy data line DDL. "n" and "k" are natural numbers. The pixels are disposed in a matrix shape including a row extending in the first direction and a column extending in the second direction. The pixels in the column are electrically connected to two adjacent data lines.

For example, the pixels in a first column V1 are disposed between a first data line DL1 and a second data line DL2. The pixels in the first column V1 are electrically connected to the first data line DL1 and the second data line DL2. Pixels in the first column V1 that are not electrically connected to the first data line DL1 are electrically connected to the second data line DL2. Pixels in a k-th column Vk are disposed between the last data line DLk and the dummy data line DDL. The pixels of the k-th column Vk are electrically connected to the last data line DLk and the dummy data line DDL. Pixels in the k-th column Vk that are not electrically connected to the last data line DLk are electrically connected to the dummy data line DDL.

The control module 200 includes a main PCB 210 and a control circuit 250 mounted on the main PCB 210. The control circuit 250 may include a timing controller. The control circuit 250 receives an image signal and a control signal from an external device. The control circuit 250 generates a data control signal for driving a data drive circuit 400 and a gate control signal for driving the gate drive circuit 110, using the control signal.

The control circuit 250 transmits the gate control signal and the data control signal to the gate drive circuit 110 and the data drive circuit 400 through the main PCB 210. Also, the control circuit 250 transmits the received image signal to the data drive circuit 400 through the main PCB 210.

The drive module 300 includes a source PCB 310 and a data drive circuit 400 mounted on the source PCB 310. The source PCB 310 is electrically connected to the main PCB 210. The source PCB 310 transmits the data control signal received from the main PCB 210 to the data drive circuit 400. The source PCB 310 transmits the gate control signal received from the main PCB 210 to the gate drive circuit 110 through lines integrated on the display panel 100 or a flexible PCB.

The data drive circuit 400 is electrically connected to a plurality of data lines, from the first data line DL1 to the k-th data line DLk, to output data voltages to the first data line DL1 to the k-th data line DLk. Also, the data drive circuit 400 is electrically connected to the dummy data line DDL to output a data voltage corresponding to the dummy data line DDL. As shown, when the dummy data line DDL is electrically connected to the pixels in the k-th column Vk, the data drive circuit 400 outputs a data voltage corresponding to the pixels in the k-th column Vk to the dummy data line DDL. Alternatively, when the dummy data line DDL is electrically connected to the pixels in the first column V1, the data drive circuit 400 may output a data voltage corresponding to the pixels in the first column V1 to the dummy data line DDL.

The data drive circuit 400 performs column inversion driving. For example, during an M-th frame, the data drive circuit 400 outputs a first polarity (−) data voltage to the first data line DL1 and a second polarity (+) data voltage, whose phase is opposite to the first polarity (−), to the second data line DL2. Then, during an (M+1)-th frame, the data drive circuit 400 outputs a second polarity (+) data voltage to the first data line DL1 and a first polarity (−) data voltage to the second data line DL2. Here, M is a natural number.

The source PCB 310 includes a dummy line 321. As shown in FIG. 1, the dummy line 321 electrically connects the data drive circuit 400 with a fan-out line of the dummy data line DDL adjacent to the last data line DLk. Alternatively, when the dummy data line DDL is adjacent to the first data line DL1, the dummy line 321 may electrically connect the data drive circuit 400 with the fan-out line of the dummy data line DDL adjacent to the first data line DL1.

Figure 2:
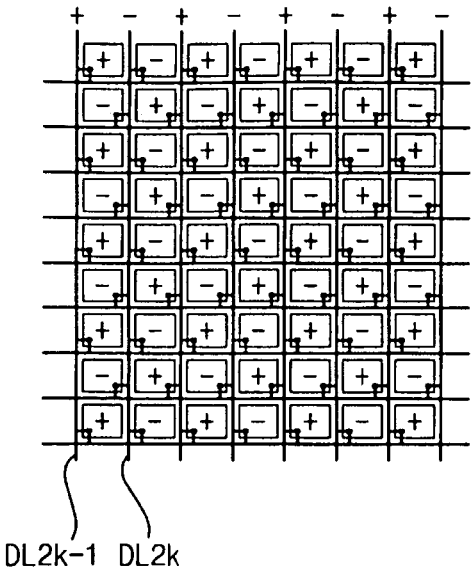
FIG. 2 is a plan view showing one example of the display panel of FIG. 1.

FIG. 2 is a plan view showing one example of the display panel of FIG. 1.

Referring to FIG. 1 and FIG. 2, pixels in the column between two adjacent data lines DL2*k*-1 and DL2*k* have a structure in which the pixels are alternately connected to the two adjacent data lines DL2*k*-1 and DL2*k*. According to a column inversion method, the first polarity (−) data voltage and the second polarity (+) data voltage, opposite to the reference voltage, are applied to the two adjacent data lines DL2*k*-1 and DL2*k*. For example, the pixels in the column disposed between a (2*k*-1) data line DL2*k*-1, to which a positive (+) data voltage is applied, and a 2*k* data line DL2*k*, to which a negative (−) data voltage is applied, are alternately connected to the (2*k*-1) data line DL2*k*-1 and the 2*k* data line DL2*k*. Accordingly, opposite data voltages (for example, "+, −, +, −") are applied to the pixels in the column.

The display panel performs a one-dot inversion in the first direction and a one-dot inversion in the second direction through the column inversion method, thereby obtaining the effect of a 1×1 dot inversion.

Figure 3:
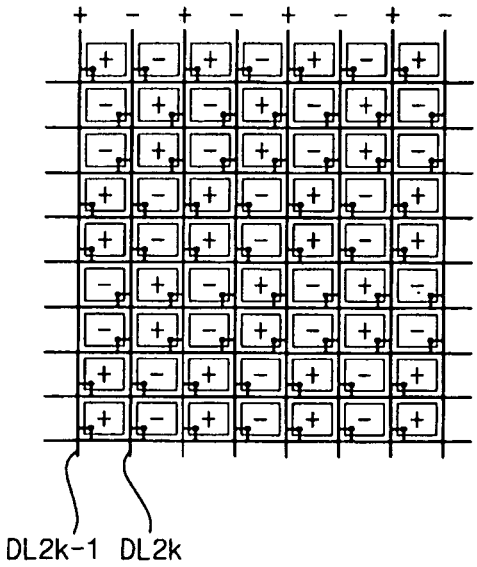
FIG. 3 is a plan view showing another example of the display panel of FIG. 1.

FIG. 3 is a plan view showing another example of the display panel of FIG. 1.

Referring to FIG. 1 and FIG. 3, the pixels in the column disposed between the (2*k*-1)-th data line DL2*k*-1, to which the positive (+) data voltage is applied, and the 2*k*-th data line DL2*k*, to which a negative (−) data voltage is applied, are alternately connected to the (2*k*-1)-th data line DL2*k*-1 and the 2*k*-th data line DL2*k* two at a time. Accordingly, opposite data voltages (for example, "+, +, −, −") are applied to the display panel.

The display panel performs a one-dot inversion in the first direction and a two dot inversion in the second direction through the column inversion method, thereby obtaining the effect of a 1×2 dot inversion.

Figure 4:
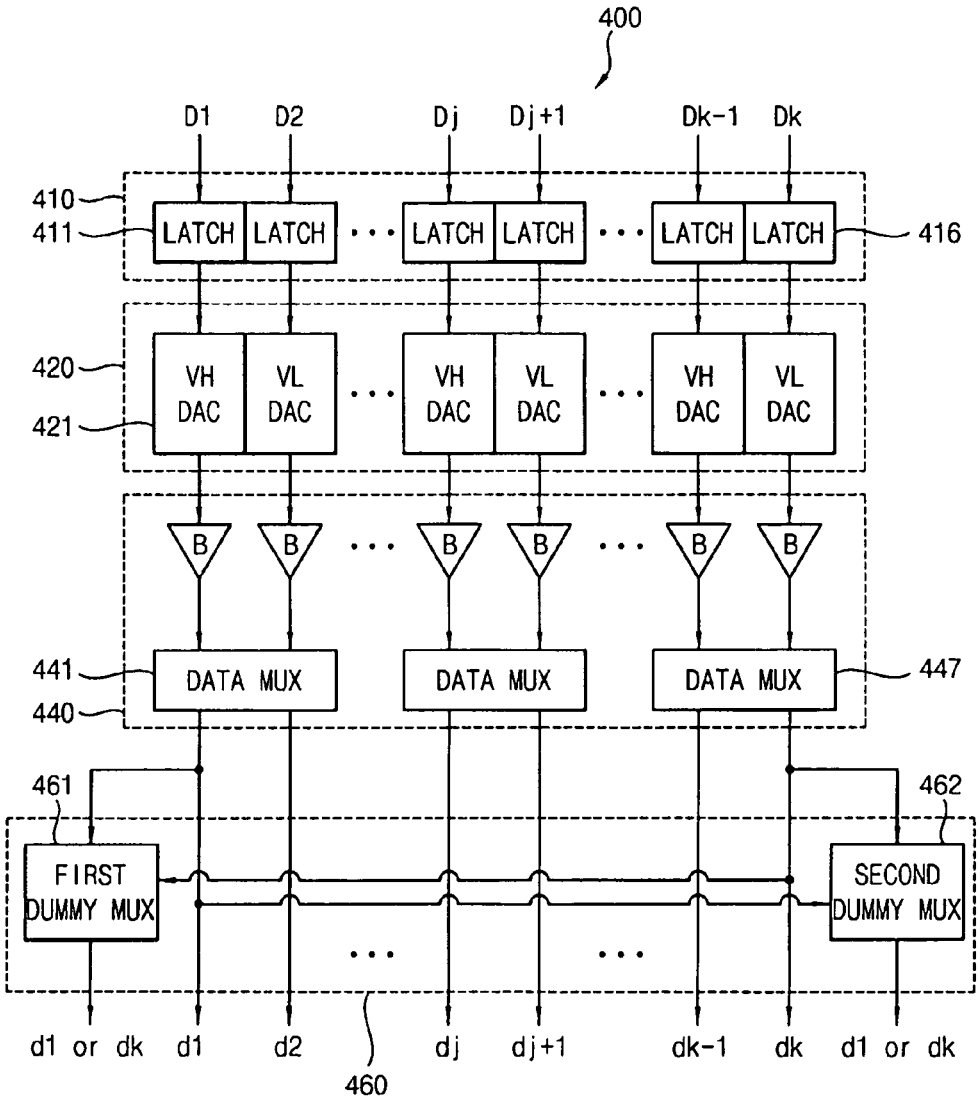
FIG. 4 is a block diagram showing the data drive circuit of FIG. 1.

FIG. 4 is a block diagram showing the data drive circuit of FIG. 1.

Referring to FIG. 1 and FIG. 4, the data drive circuit 400 includes a latch part 410, a digital-to-analog conversion part 420, an output part 440, and a dummy output part 460.

The latch part 410 includes a plurality of latches. For example, the latch part 410 includes a first latch 411 to a k-th latch 416, to which the first data D1 to the k-th data Dk is respectively applied. The first latch 411 to the k-th latch 416 respectively correspond to the first data line DL1 to the k-th data line DLk.

The first latch 411 to the k-th latch 416 store the first data D1 to the k-th data Dk, and the latches are synchronized to respectively store data during a certain period according to a horizontal synchronization signal, and output the stored data.

The digital-to-analog conversion part 420 includes a plurality of digital-to-analog converters (DAC) to convert data D1 to Dk output from the latch part 410 into data voltages of an analog type.

For example, a first DAC 421 includes a VL_DAC to convert the received data into a first polarity data voltage VL and a VH_DAC to convert received data into a second polarity data voltage VH, opposite to the first polarity to the reference voltage. According to the column inversion method, the first DAC 421 converts the first data D1 output from the first latch 411 into a first polarity data voltage VL_d1 and the second data D2 output from the second latch 412 into a second polarity data voltage VH_d2.

The output part 440 includes a plurality of buffers B and a plurality of data multiplexers (MUXes) 441 and 447. The buffers B buffer data voltages output from the digital-to-analog conversion part 420 and output the data voltages.

The data MUXes 441 and 447 selectively output the data voltages output from the buffers B according to an inversion method. For example, a first data MUX 441 outputs the first polarity data voltage VL_d1 to the first data line DL1 and the second polarity data voltage VH_d2 to the second data line DL2. Alternatively, the output part 440 reverses the data voltage by a frame unit. For example, during the M-th frame, the output part 440 outputs the first polarity data voltage VL_d1, and during the (M+1)-th frame, outputs the second polarity data voltage VH_d1, to the second data line DL1.

The dummy output part 460 includes a first dummy MUX 461 and a second dummy MUX 462. The first dummy MUX 461 is adjacent to an output terminal that outputs the first data voltage of the output part 440. The first dummy MUX 461 selects one data voltage of the data voltages d1 and dk respectively output from a first output terminal and a last output terminal, in response to a control signal provided from the control circuit 250, and outputs the selected data voltage to the dummy data line DDL. In this case, the dummy data line DDL is adjacent to the first data line DL1 of the data lines and applies the data voltages to the pixels in the first column.

The second dummy MUX 462 is adjacent to an output terminal that outputs the last data voltage of the output part 440. The second dummy MUX 462 selects one data voltage of the data voltages d1 and dk input from the first output terminal and the last output terminal of the output part 440, respectively, in response to the control signal provided from the control circuit 250, and outputs the selected data voltage to the dummy data line DDL. In this case, the dummy data line DDL is adjacent to the last data line DLk of the data lines and applies the data voltage to the pixels in the k-th column.

Here, while it is illustrated that the dummy output part 460 includes both of the first dummy MUX 461 and the second dummy MUX 462, the dummy output part 460 may alternatively include one dummy MUX according to a position of the dummy data line DDL formed on the display panel. For example, when the dummy data line DDL is adjacent to the first data line DL1 of the display panel, the dummy output part 460 may include only the first dummy MUX 461, and when the dummy data line DDL is adjacent to the last data line DLk of the display panel, the dummy output part 460 may include only the second dummy MUX 462.

Figure 5:
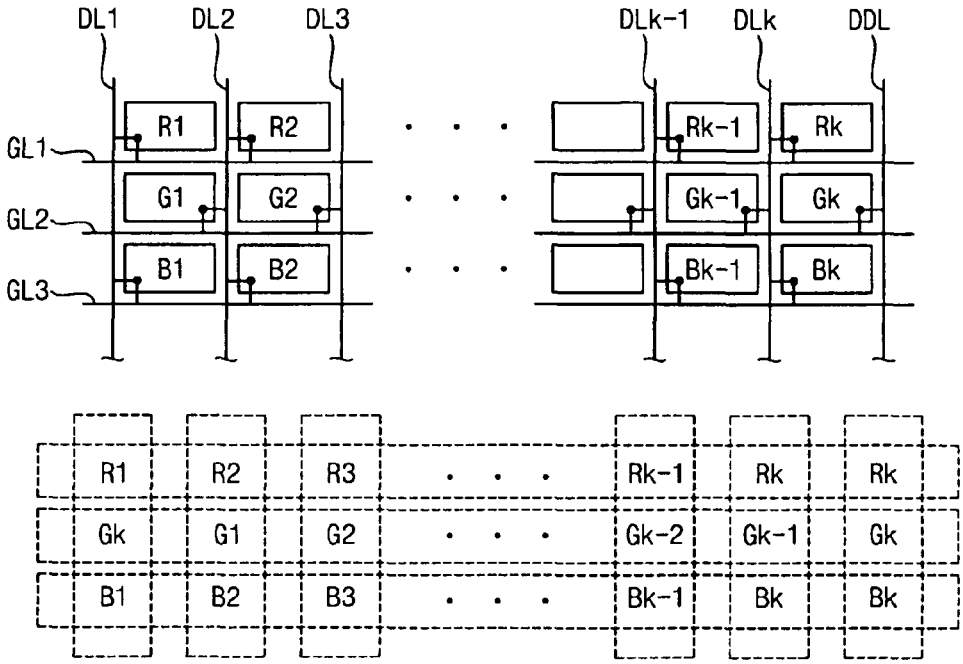
FIG. 5 is a schematic diagram showing one example of a driving method of the data drive circuit of FIG. 4.

FIG. 5 is a schematic diagram showing one example of a driving method of the data drive circuit of FIG. 4.

Referring to FIG. 4 and FIG. 5, the dummy data line DDL is adjacent to the last data line DLk to apply the data voltage to the pixels in the k-th column. In this case, an output end portion of the first dummy MUX 461 is electrically floated with respect to the display panel 100.

For example, the latch part 410 receives data DR1, DR2, . . . , DRk-1 and DRk, where k is a natural number, the data corresponding to the pixels in the first row electrically connected to the first gate line GL1.

The data DR1, DR2, . . . , DRk-1, and DRk received through the latch part 410, the digital-to-analog conversion part 420, and the output part 440 are output as data voltages of an analog type R1, R2, . . . , Rk-1, and Rk. The second dummy MUX 462 selectively outputs the k-th data voltage Rk from among the first data voltage R1 and the k-th data voltage Rk output from the output part 440.

Accordingly, the data drive circuit 400 outputs the data voltages R1, R2, . . . , Rk-1, and Rk to the first data line DL1 to the k-th data line DLk, respectively, and outputs the data voltage Rk to the dummy data line DDL. As FIG. 5 shows, since the last pixel in the first row is not connected to the dummy data line DDL, the data voltage Rk applied to the dummy data line DDL may not drive any pixels.

After a horizontal period (1H), the latch part 410 receives data DGk, DG1, DG2, . . . , DGk-2, and DGk-1 corresponding to the pixels in the second row electrically connected to the second gate line GL2. The pixels in the column have a pixel structure in which the pixels are alternately connected to the adjacent data lines, and thus data DGk, DG1, DG2, . . . , DGk-2, and DGk-1 corresponding to the pixels in the second row precede data DR1, DR2, . . . , DRk-1, and DRk corresponding to the pixels in the first row by one pixel.

The data DGk, DG1, DG2, . . . , DGk-2, and DGk-1 received through the latch part 410, the digital-to-analog conversion part 420, and the output part are output as the data voltages Gk, G1, G2, . . . , Gk-2, and Gk-1. The second dummy MUX 462 selectively outputs the first data voltage Gk from among the first data voltage Gk and the k-th data voltage Gk-1 output from the output part 440.

Accordingly, the data drive circuit 400 outputs the data voltages Gk, G1, . . . , Gk-2, and Gk-1 respectively to the first data line DL1 to the k-th data line DLk, and outputs the data voltage Gk to the dummy data line DDL. As FIG. 5 shows, since the first pixel in the second row is not connected to the first data line DL1, the data voltage Gk applied to the first data line DL1 may not drive any pixels.

After a period 1H, the latch part 410 receives data DB1, DB2, . . . , DBk-1, and DBk corresponding to the pixels in the third row electrically connected to the third gate line GL3. According to an alternately connected pixel structure, data DB1, DB2, . . . , DBk-1, and DBk corresponding to the pixels in the third row may be delayed with respect to data DGk, DG1, DG2, . . . , DGk-1 corresponding to the pixels in the second row by one pixel.

The data DB1, DB2, . . . , DBk-1, and DBk received through the latch part 410, the digital-to-analog conversion part 420, and the output part 440 are output as the data voltages B1, B2, . . . , Bk-1, and Bk. The second dummy MUX 462 selectively outputs the k-th data voltage Bk from among the first data voltage B1 and the k-th data voltage Bk of the output part 440.

Accordingly, the data drive circuit 400 outputs the data voltages B1, B2, . . . , Bk-1 and Bk respectively to the first data line DL1 to the k-th data line DLk, and outputs the data voltage Bk to the dummy data line DDL. As FIG. 5 shows, since the last pixel in the third row is not connected to the dummy data line DDL, the data voltage Bk applied to the dummy data line DDL may not drive any pixels.

Therefore, when the dummy data line DDL is adjacent to the last data line DLk, the second dummy MUX 462 electrically connected to the dummy data line DDL selectively outputs the data voltage d1 corresponding to the last data line DLk and the data voltage dk corresponding to the first data line DL1 in response to the control signal.

Figure 6:
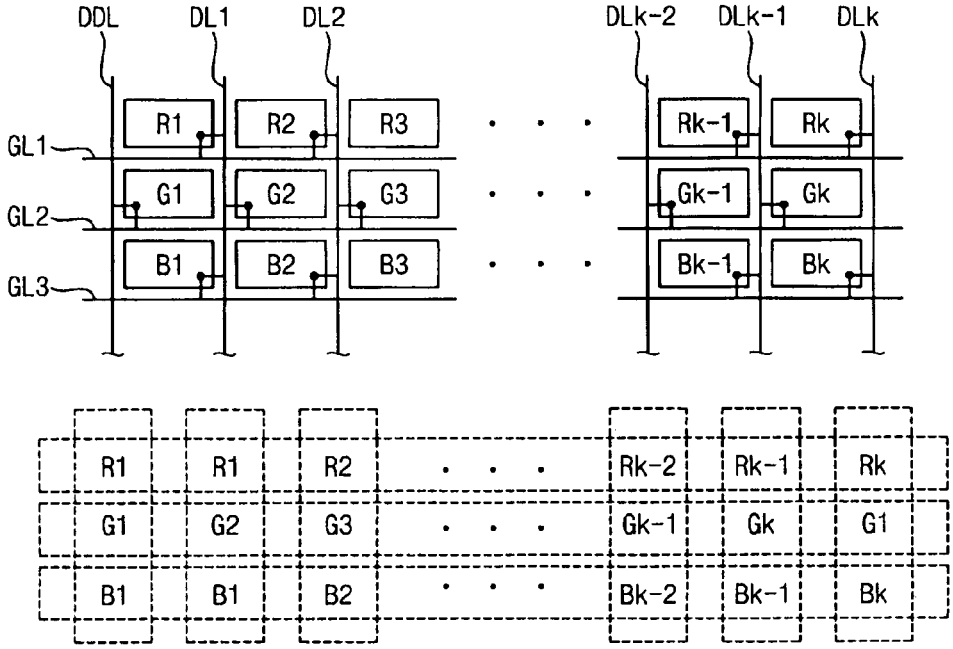
FIG. 6 is a schematic diagram showing another example of a driving method of the data drive circuit of FIG. 4.

FIG. 6 is a schematic diagram showing another example of a driving method of the data drive circuit of FIG. 4.

Referring to FIG. 4 and FIG. 6, the dummy data line DDL is adjacent to the first data line DL1 to apply the data voltage to the pixels in the first column. In this case, an output end portion of the second dummy MUX 462 is electrically floated with respect to the display panel 100.

For example, the latch part 410 receives data DR1, DR2, . . . , DRk-1, and DRk corresponding to the pixels in the first row electrically connected to the first gate line GL1.

The data DR1, DR2, . . . , DRk-1, and DRk received through the latch part 410, the digital-to-analog conversion part 420, and the output part are output as the data voltages R1, R2, . . . , Rk-1, Rk of an analog type. The first dummy MUX 461 selectively outputs the first data voltage R1 from among the first data voltage R1 and the last data voltage Rk output from the output part 440.

Accordingly, the data drive circuit 400 outputs the data voltages R1, R2, . . . , Rk-1, and Rk respectively to the first data line DL1 to the k-th data line DLk, and outputs the data voltage R1 to the dummy data line DDL. As FIG. 6 shows, since the first pixel in the first row is not connected to the dummy data line DDL, the data voltage R1 applied to the dummy data line DDL may not drive any pixels.

After a period 1H, the latch part 410 receives data DG2, DG3, . . . , DGk-1, DGk, and DG1 corresponding to the pixels in the second row electrically connected to the second gate line GL2. The pixels in the column have the pixel structure in which the pixels are alternately connected to adjacent data lines, and thus data DG2, DG3, . . . , DGk-1, DGk, and DG1 corresponding to the pixels in the second row precede data DR1, DR2, . . . , DRk-1, and DRk corresponding to the pixels in the first row by one pixel.

The data DG2, DG3, . . . , DGk-1, DGk, and DG1 received through the latch part 410, the digital-to-analog conversion part 420, and the output part are output as the data voltages G2, G3, . . . , Gk-1, Gk, and G1 of an analog type. The first dummy MUX 461 selectively outputs the last data voltage G1 from among the first data voltage G2 and the last data voltage G1 outputted from the output part 440.

Accordingly, the data drive circuit 400 outputs the data voltages G2, G3, . . . , Gk-1, Gk, and G1 to the first data line DL1 to the k-th data line DLk and outputs the data voltage G1 to the dummy data line DDL. As FIG. 6 shows, since the last pixel in the second row is not connected to the last data line DLk, the data voltage G1 applied to the k-th data line DLk may not drive any pixels.

After a period 1H, the latch part 410 receives data DB1, DB2, . . . , DBk-1, and DBk corresponding to the pixels in the third row electrically connected to the third gate line GL3. According to an alternately connected pixel structure, data DB1, DB2, . . . , DBk-1, and DBk corresponding to the pixels in the third row may be delayed with respect to data DGk, DG1, DG2, . . . , DGk-2, and DGk-1 corresponding to the pixels in the second row by one pixel.

The data DB1, DB2, . . . , DBk-1, and DBk received through the latch part 410, the digital-to-analog conversion part 420, and the output part are output as the data voltages B1, B2, . . . , Bk-1, and Bk of an analog type. The first dummy MUX 461 selectively outputs the first data voltage B1 from among the first data voltage B1 and the k-th data voltage Bk of the output part 440.

Accordingly, the data drive circuit 400 outputs the data voltages B1, B2, . . . , Bk-1, and Bk to the first data line DL1 to the k-th data line DLk and outputs the data voltage B1 to the dummy data line DDL. As FIG. 6 shows, since the first pixel in the third row is not connected to the dummy data line DDL, the data voltage B1 applied to the dummy data line DDL may not drive any pixels.

Therefore, when the dummy data line DDL is adjacent to the first data line DL1, the first dummy MUX 461 electrically connected to the dummy data line DDL selectively outputs the data voltage d1 corresponding to the last data line DLk and the data voltage dk corresponding to the first data line DL1, in response to the control signal.

According to exemplary embodiments of the present invention, a data drive circuit includes a dummy output part outputting one of data voltages output from a first output terminal and a k-th output terminal to a dummy data line, and thus the size of the data drive circuit may be reduced and the structure of the data drive circuit may be simplified.

In order to electrically connect the dummy data line with a first data line or a last data line, additional lines added to a display panel and PCB may be removed, which may thereby prevent a signal delay between a dummy data line and a first data line or a last data line connected to the dummy data line.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of driving data, the method comprising:

receiving data that corresponds to pixels disposed in adjacent rows;

converting the data into data voltages of an analog type and outputting the data voltages to respective data lines;

receiving a first data voltage and a last data voltage, the first data voltage and the last data voltage being included in the data voltages output to the data lines;

alternately selecting the first data voltage and the last data voltage; and sequentially outputting each selected data voltage, via a dummy data line disposed adjacent to the data lines and connected to the pixels, to the pixels connected to the dummy data line, wherein all of the pixels connected to the dummy data line are disposed in a display area and are configured to output light of an image corresponding to the data voltages, and wherein in each of the rows, each selected data voltage drives pixels connected to only one of the dummy data line and a corresponding data line of the data lines connected to a pixel of the pixels applied with the same each selected data voltage.

2. The method of claim 1, wherein a first polarity data voltage and a second polarity data voltage are applied to adjacent data lines, the first polarity being an opposite polarity of the second polarity.

3. The method of claim 2, wherein during an M-th frame, the first polarity data voltage is applied to a first data line and the second polarity data voltage is applied to a second data line adjacent the first data line, and during an (M+1)-th frame, the second polarity data voltage is applied to the first data line and the first polarity data voltage is applied to the second data line, M being a natural number.

4. A data drive circuit, comprising:

a latch part to receive and output data that corresponds to pixels disposed in adjacent rows;

a digital-to-analog conversion part to convert the data output from the latch part into data voltages of an analog type;

an output part to buffer the data voltages and to output the data voltages to corresponding data lines; and a dummy output part to receive a first data voltage and a last data voltage, of the data voltages, to alternately select the first data voltage and the last data voltage, and to sequentially output each selected data voltage, via a dummy data line disposed adjacent to the data lines and connected to the pixels, to the pixels connected to the dummy data line, the first data voltage and the last data voltage being included in the data voltages output to the data lines, wherein all of the pixels connected to the dummy data line are disposed in a display area and are configured to output light of an image corresponding to the data voltages, and wherein in each of the rows, each selected data voltage drives pixels connected to only one of the dummy data line and a corresponding data line of the data lines connected to a pixel of the pixels applied with the same each selected data voltage.

5. The data drive circuit of claim 4, wherein the dummy output part comprises:

a first dummy multiplexer (MUX) disposed adjacent to an output terminal that outputs the first data voltage; and a second dummy MUX disposed adjacent to an output terminal that outputs the last data voltage.

6. The data drive circuit of claim 4, wherein the output part outputs a first polarity data voltage and a second polarity data voltage to adjacent data lines, the first polarity being an opposite polarity of the second polarity.

7. The data drive circuit of claim 4, wherein during an M-th frame, the output part outputs a first polarity data voltage to a first data line and a second polarity data voltage to a second data line adjacent the first data line, and during an (M+1)-th frame, the output part outputs the second polarity data voltage to the first data line and the first polarity data voltage to the second data line, and wherein the first polarity is an opposite polarity of the second polarity, M is a natural number.

8. A display apparatus, comprising:

a display panel comprising pixels, data lines disposed between the pixels, a dummy data line disposed adjacent to the data lines, and gate lines crossing the data lines; and a data drive circuit comprising an output part to output data voltages to the data lines and a dummy output part to receive a first data voltage and a last data voltage, to alternately select the first data voltage and the last data voltage, and to sequentially output each selected data voltage, via the dummy data line, to the pixels connected to the dummy data line, the first data voltage and the last data voltage being included in the data voltages output to the data lines, wherein all of the pixels connected to the dummy data line are disposed in a display area and are configured to output light of an image corresponding to the data voltages, and wherein in each of the rows, each selected data voltage drives pixels connected to only one of the dummy data line and a corresponding data line of the data lines connected to a pixel of the pixels applied with the same each selected data voltage.

9. The display apparatus of claim 8, wherein the dummy output part comprises:

a first dummy multiplexer (MUX) disposed adjacent to an output terminal that outputs the first data voltage; and a second dummy multiplexer (MUX) disposed adjacent to an output terminal that outputs the last data voltage.

10. The display apparatus of claim 9, wherein when the dummy data line is adjacent to a first data line of the data lines, the first dummy MUX outputs a data voltage to the dummy data line.

11. The display apparatus of claim 9, wherein when the dummy data line is adjacent to a last data line of the data lines, the second dummy MUX outputs a data voltage to the dummy data line.

12. The display apparatus of claim 8, wherein the display panel comprises a column of pixels arranged between adjacent data lines, and pixels of the column of pixels are alternately connected to the adjacent data lines.

13. The display apparatus of claim 8, further comprising a source printed circuit board (PCB) comprising the data drive circuit, the source PCB being connected to the display panel, wherein the source PCB comprises a dummy line, the source PCB connecting the dummy data line with the dummy output part.

14. The display apparatus of claim 8, wherein the data drive circuit outputs a first polarity data voltage and a second polarity data voltage to the adjacent data lines, the first polarity being an opposite polarity of the second polarity.

15. The display apparatus of claim 8, wherein during an M-th frame, the data drive circuit outputs a first polarity data voltage to a first data line and a second polarity data voltage to a second data line adjacent the first data line, and during an (M+1)-th frame, the data drive circuit outputs the second polarity data voltage to the first data line and the first polarity data voltage to the second data line, and wherein the first polarity is an opposite polarity of the second polarity, and M is a natural number.

* * * * *